US008938854B2

(12) United States Patent
Lanzani

(10) Patent No.: US 8,938,854 B2
(45) Date of Patent: Jan. 27, 2015

(54) HINGE FOR A HOUSEHOLD APPLIANCE WITH IMPROVED ELASTICALLY DEFORMABLE MEANS

(71) Applicant: Oreste Lanzani, Bagnolo Mella (IT)

(72) Inventor: Oreste Lanzani, Bagnolo Mella (IT)

( * ) Notice: Subject to any disclaimer, the term of this patent is extended or adjusted under 35 U.S.C. 154(b) by 18 days.

(21) Appl. No.: 13/763,934

(22) Filed: Feb. 11, 2013

(65) Prior Publication Data

US 2013/0212835 A1 Aug. 22, 2013

(30) Foreign Application Priority Data

Feb. 17, 2012 (IT) ..... MI2012A0237

(51) Int. Cl.

| | |
|---|---|
| ***E05F 1/08*** | (2006.01) |
| ***E05F 1/12*** | (2006.01) |
| ***E05D 3/14*** | (2006.01) |
| ***F25D 23/02*** | (2006.01) |

(52) U.S. Cl.

CPC ..... *E05F 1/1253* (2013.01); *E05D 3/14* (2013.01); *F25D 23/028* (2013.01); *E05Y 2900/302* (2013.01); *E05Y 2900/31* (2013.01)

USPC ..... 16/288

(58) Field of Classification Search

USPC ..... 16/286–288, 294; 126/194

See application file for complete search history.

(56) References Cited

U.S. PATENT DOCUMENTS

| | | | | |
|---|---|---|---|---|
| 1,930,308 | A * | 10/1933 | Devlin | 16/288 |
| 5,471,709 | A * | 12/1995 | Lanzani | 16/238 |
| 5,497,534 | A | 3/1996 | Caruso | |
| 5,522,656 | A * | 6/1996 | Jenkins | 292/79 |
| 7,934,290 | B2 * | 5/2011 | Gherardi et al. | 16/288 |
| 8,572,808 | B2 * | 11/2013 | Bonomie et al. | 16/286 |
| 2010/0269293 | A1 * | 10/2010 | Wisniewski | 16/250 |
| 2011/0000050 | A1 | 1/2011 | Lanzani | |
| 2011/0089801 | A1 | 4/2011 | Bonomie et al. | |
| 2012/0118842 | A1 * | 5/2012 | Salice | 211/144 |

FOREIGN PATENT DOCUMENTS

| | | |
|---|---|---|
| EP | 2336467 A1 | 6/2011 |

OTHER PUBLICATIONS

Search Report of Oct. 11, 2012 for Italian Patent Application No. MI2012A 000237 filed Feb. 17, 2012.

* cited by examiner

*Primary Examiner* — Victor Batson
*Assistant Examiner* — Matthew Sullivan
(74) *Attorney, Agent, or Firm* — Novak Druce Connolly Bove + Quigg LLP

(57) ABSTRACT

Hinge, to connect flat closing element to household appliance body in correspondence to a body opening, including: first supporting structure to bind to structure or front bearing wall of the body, second supporting structure to bind to flat closing element, first and second connecting elements to connect the first and second supporting structure, and elastically deformable member interacting with at least one of the two connecting elements, to push the closing element against the body opening. The first and second connecting elements and at least first and second portions respectively of the first and second supporting structure form sides of an articulated quadrilateral lying in one or more planes, perpendicular to the flat closing element. The quadrilateral for opening and closing the closing element between operative positions has hinge elements of external portions of the first and second connecting elements to the first and second portions of the supporting structures.

23 Claims, 5 Drawing Sheets

HINGE FOR A HOUSEHOLD APPLIANCE WITH IMPROVED ELASTICALLY DEFORMABLE MEANS

CROSS-REFERENCE TO RELATED APPLICATION

This claims the benefit of Italian patent application no. MI2012A 000237 filed 17 Feb. 2012, incorporated herein by reference.

FIELD OF THE INVENTION

The invention relates to a hinge. In particular, the present invention relates to a hinge for a household appliance, adapted to connect to one another at least one flat closing element, to the body of said household appliance in correspondence to an opening provided in said body, said hinge allowing to rotate said flat closing element between a first operative position wherein it closes said opening, to a second operative position angularly spaced by at least 90° with respect to said first operative position, and preferably angularly spaced by at least 100°. An object of the present invention is a hinge according to the pre-characterizing part of claim 1.

BACKGROUND OF THE INVENTION

Hinges of the type indicated above have long been known; they are for example described in U.S. Pat. No. 5,471,709 and have long been marketed under the trademark "INGOL".

The known hinges are used to support doors of refrigerators of small or medium size but have not up to now been used for large dimension refrigerator doors, i.e. for doors which can weigh up to 100 kg and with opening angles equal to or greater than 100°.

The known hinges also do not allow the housing therein of tubes for the passage of fluids, for example water, from the inside of the refrigerator to its door.

The known hinges also comprise elastic means therein that despite having a good operability if the refrigerator door provides gaskets of magnetic type are not always able to guarantee to exert a force upon the refrigerator door so as to ensure that it remains closed and in contact with the refrigerator body even in the absence of said magnetic gaskets.

Furthermore the elastic means of known hinges while having a good operability in normal use conditions are not able to overcome wear tests involving particularly burdensome cycles of opening/closing of the hinge (e.g. tests involving more than 900,000 cycles of opening and closing).

The known hinges used for large dimension refrigerator doors, for example of the type produced by the company Hettich, are connectable to said doors only by inserting them into appropriate recessed seats, formed in the body of the refrigerator by removing a portion of its insulating material, i.e. compromising in part the refrigerator insulation.

SUMMARY OF THE INVENTION

The purpose of the present invention is to provide an improved hinge dimensioned and shaped so that it can comprise more reliable elastic means than those present in the hinges of the prior art and so that the components of the hinge are dimensioned and shaped so as to be able to support large dimension refrigerator doors and/or which may allow door opening angles greater than 90° and/or that allow not having to modify and/or decrease the insulating material of the refrigerator body.

A further object is to provide a hinge whose components are dimensioned and shaped so as to be able to provide a tube inside the hinge, for example for the passage of a fluid or electric cables.

These and other objects which will be apparent to one skilled in the art are attained by a hinge according to the appended claims.

The hinge is for a household appliance, adapted to connect to at least one flat closing element to the body of said household appliance in correspondence to an opening provided in said body, said hinge comprising: a first supporting structure adapted to be bound to a structure or a front bearing wall of the body of said household appliance, a second supporting structure adapted to be bound to said flat closing element, first and second connecting elements adapted to connect to one another said first and second supporting structure, and elastically deformable means interacting with at least one of said two connecting elements, to exert a force that pushes said closing element against said opening of the body of the household appliance, wherein said first and second connecting elements and the first and second supporting structure form an articulated quadrilateral lying in one or more planes, perpendicular to said flat closing element, the sides of said articulated quadrilateral being formed by: said first connecting element, said second connecting element and at least a first and a second portion respectively of said first and second supporting structure, said quadrilateral being adapted to define means for opening and closing said closing element between said two operative positions, said quadrilateral comprising hinge means of external portions of said first and second connecting elements to said first and second portion of said supporting structures.

BRIEF DESCRIPTION OF THE DRAWINGS

For a better understanding of the present invention drawings are attached by way of a not limitative example wherein.

DETAILED DESCRIPTION OF THE PREFERRED EMBODIMENTS

Figure 1:
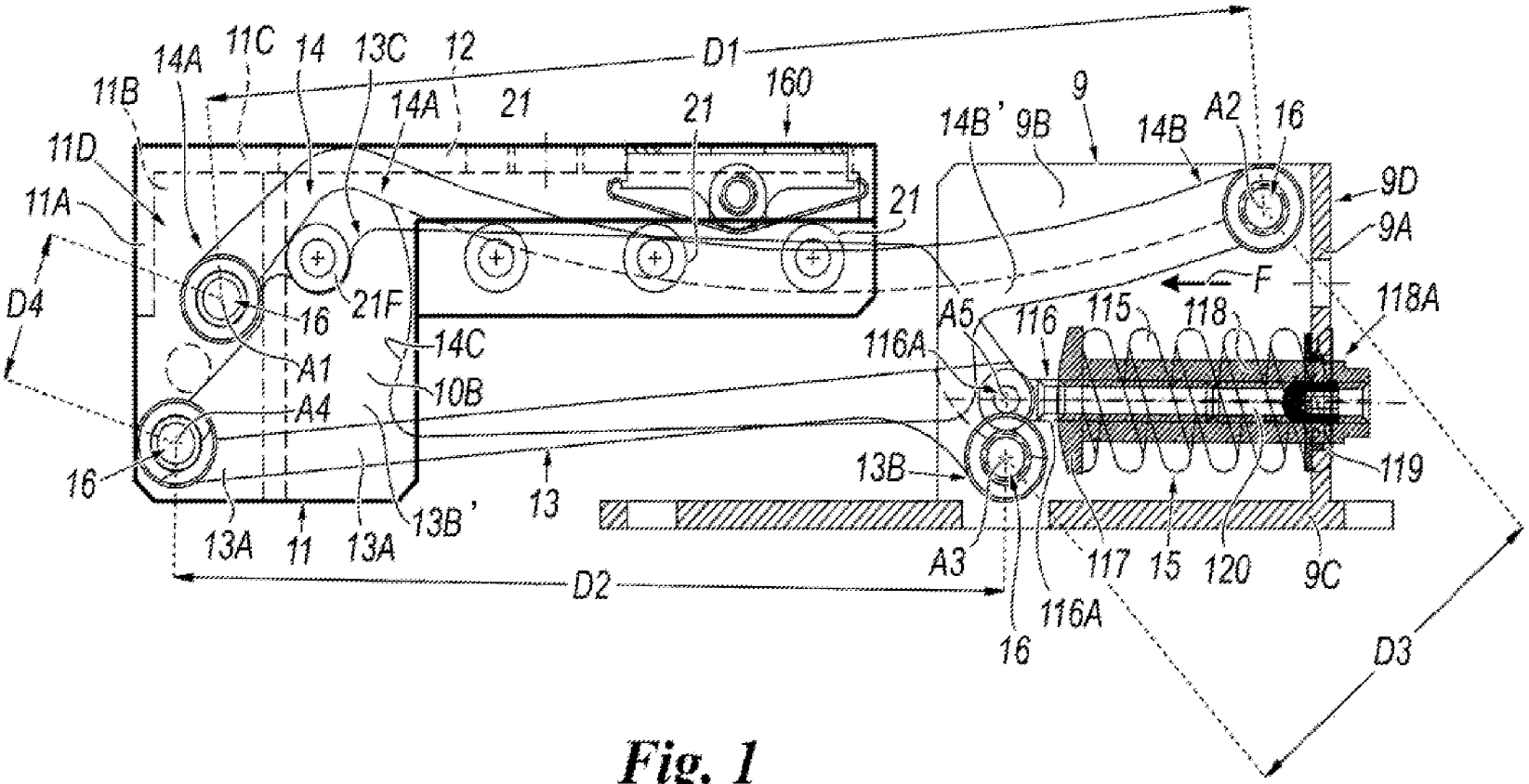
FIG. 1 shows an enlarged schematic view from above of a hinge according to the invention, FIG. 2, 3, 4, 5 show views of the same from above partially sectioned, in different scales and in different use positions (0°, 100°, 110°, 0°), when it is applied to a built-in refrigerator within a piece of cabinetry and with a panel bound to the door of the refrigerator itself.
Figure 2:
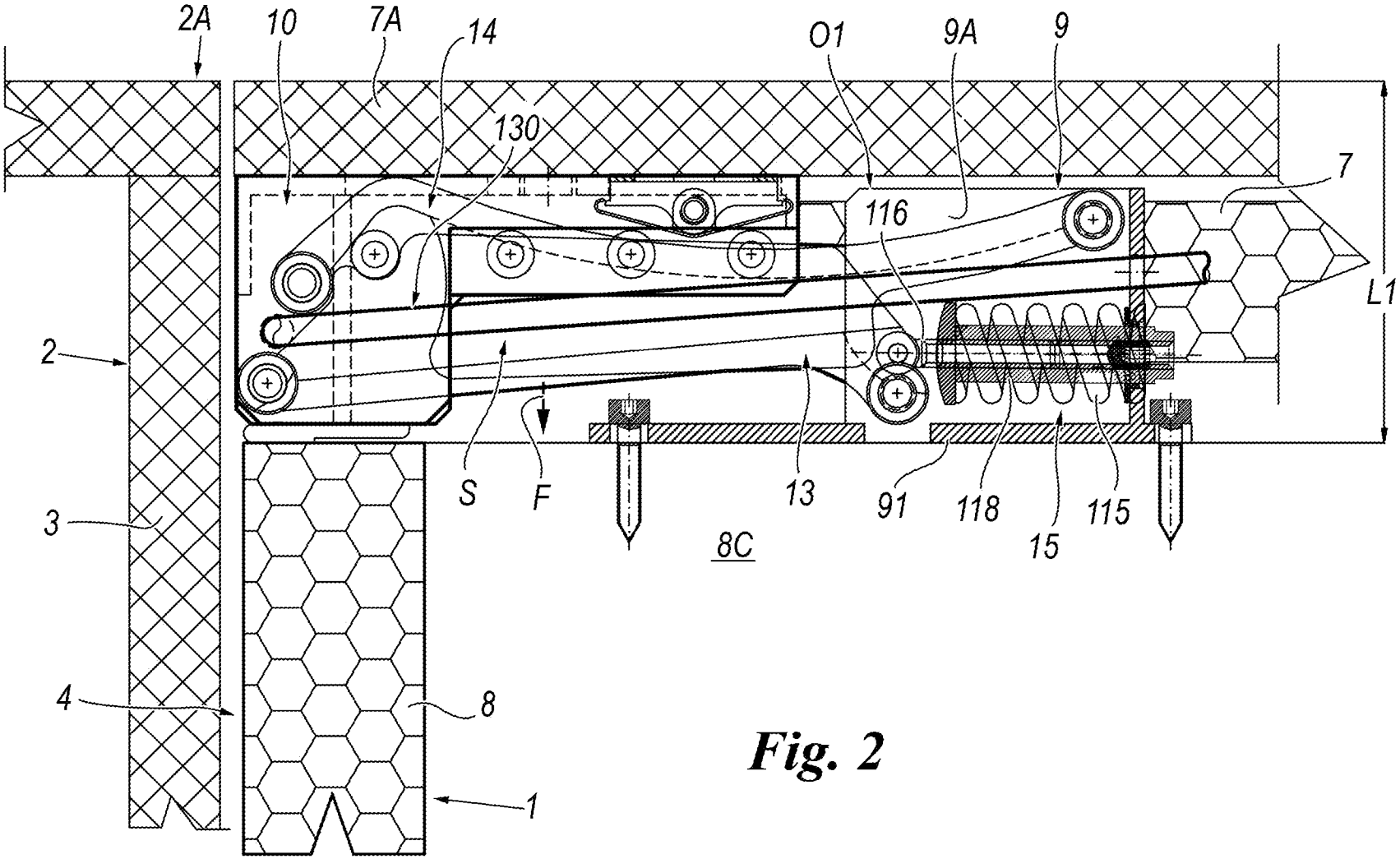

With reference to the above figures, they show a hinge for a household appliance 1 (partially represented in FIG. 5), in particular a refrigerator or a freezer, adapted to connect to one another at least one flat closing element, in particular a door 7, adapted to close an opening 8C provided in a body 8 (partially shown) of said household appliance. The opening 8C is for example delimited by an edge 8A and/or a front supporting structure for the hinge 8B, provided in the body of the household appliance. The household appliance shown in FIGS. 2-5 is of the type adapted to be built-in within a piece of cabinetry 2, for example a column unit cabinet or a cupboard, and, more particularly, the body 1 of the household appliance is adapted to be inserted in a seat 4 delimited by walls 3 of said cabinet element 2, while the door 7 of the household appliance is of the type adapted to be removably associated with a second door or panel 7A adapted to close the seat 4 of the cabinet element.

Figure 3:
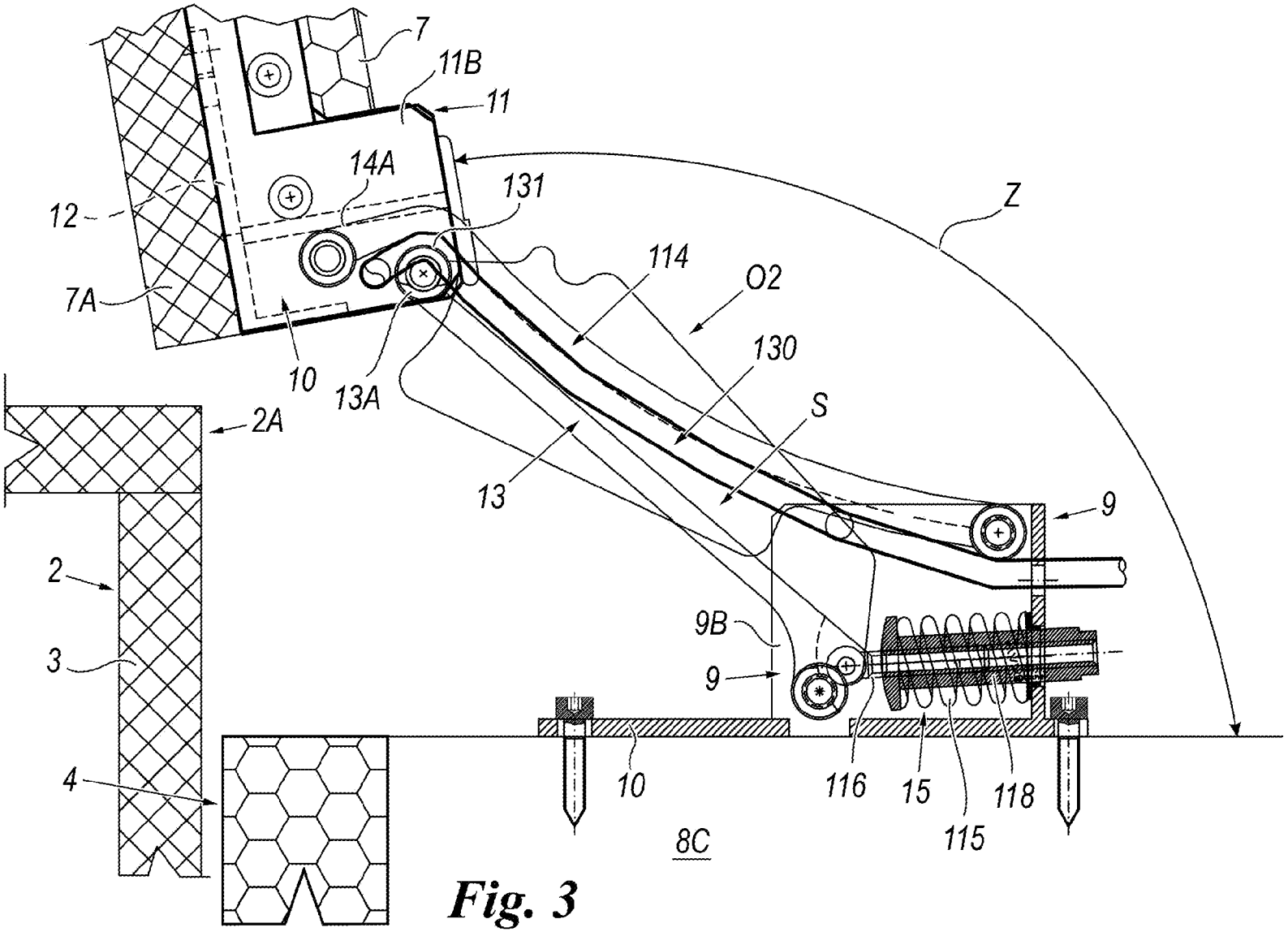

The hinge allows to rotate the closing element 7 and the eventual panel 7A associated therewith from a first operative position (O1 FIGS. 2 and 5) wherein it closes the opening 8C of the household appliance to a second operative position (O2 FIG. 3) angularly spaced by an angle Z of approximately 100° with respect to the first position. As shown in FIG. 3 in the operative position of maximum opening O2 both the door 7 and the panel 7A associated therewith are spaced from the outermost edge 2A of the cabinet element 2 and at the same time allow a full and easy access to the opening 8C of the refrigerator.

The hinge preferably comprises:

- a first supporting structure 9 adapted to be bound to a structure, an edge or a front bearing wall 8B (FIG. 5) of the body 8, of the household appliance 1,
- a second supporting structure 11 adapted to be bound to a portion of the door 7 and/or to the panel 7A,
- first 14 and second 13 connecting elements adapted to connect to one another said first 9 and second 11 supporting structure,
- and elastically deformable means 15, interacting with only one of said two connecting elements 14, 13, preferably with the 13 shorter and closer to the opening 8C of the household appliance, to exert a force F (FIG. 1) which will push and maintain the closing element 7, 7A in closing said opening 8*c* of the body of the household appliance when said closing element is in its first operative position 01.

Preferably each of the supporting structures 9 and 11 comprises two base walls 9B, 11B overlapping and parallel to each other and two further walls 9A, 9C, 11A, 11C perpendicular to said base walls and connecting them to each other along two of their adjoining and perpendicular edges, so as to form a box-shaped element open on two faces from which protrude the connecting elements 13 and 14.

The first and second connecting elements 14, 13 and the first and second supporting structure 9, 11 form an articulated quadrilateral lying in multiple planes parallel to each other, and perpendicular to the plane of the door 7; the sides of said articulated quadrilateral are formed by: the first connecting element 14, the second connecting element 13, and by at least a first 9D and a second 11D portion respectively of said first and second 11 supporting structure. The quadrilateral is adapted to define means to open and close the door 7 between the two operative closing O1 and opening O2 positions and between all the positions comprised between these two. In the case wherein the household appliance is a refrigerator of the type adapted to be built-in, thanks to the above articulated quadrilateral it is possible to move, the door 7 and the respective said panel 7A so that said door and said panel does not interfere with an angular portion 2A of the cabinet element 2 in which the refrigerator is built-in (as shown in FIG. 3).

The articulated quadrilateral comprises hinge means 16 of external portions 13A, 13B, 14A, 14B of the first and second connecting elements 13, 14 to the first and second portions 9D, 11D of the supporting structures 9, 11; adapted to allow the quadrilateral to assume a plurality of different operative positions between the closed position O1 and that of maximum opening O2.

In the closed position O1 (FIGS. 1 and 2) the hinge axes A1, A2, A3, A) of the quadrilateral define:

- a first distance D1 defined by the line passing through the hinge axes A1, A2 provided in the first 14A and in the second 14B ends of the first connecting element 14,
- a second distance D2 defined by the line passing through the hinge axes A3, A4 provided in the first 13A and in the second 13B end of the second connecting element 13,
- a third distance D3 defined by the line passing through the hinge axes A2, A3 provided in the second end 14B of the first element 4 and the second end 13B of the second element 13,
- a fourth distance D4 defined by the line passing through the hinge axes A4, A1 provided in the first end 13A of the second element 13 and the first end 14A of the first element 14.

Preferably, the distances D1, D2, D3, D4, are all different from one another, and:

- the distance D1 is comprised between 165.5 mm and 169.5 mm and preferably is equal to 167.5 mm or is comprised in a range delimited by said values multiplied by a factor K1, namely:

$$(165.5\ \text{mm}\times K1)<=D1<=(169.5\ \text{mm}\times K1),$$

- the distance D2 is comprised between 131 mm and 135 mm and preferably is equal to 133 mm, or is comprised in a range delimited by said values multiplied by a factor K1, namely:

$$(131\ \text{mm}\times K1)<=D2<=(135\ \text{mm}\times K1),$$

- the distance D3 is comprised between 53.2 mm and 57.2 mm and preferably is equal to 55.2 mm or is comprised in a range delimited by said values multiplied by a factor K1, namely:

$$(53.2\ \text{mm}\times K1)<=D3<=(57.2\ \text{mm}\times K1)$$

- the distance D4 is comprised between 20.4 mm and 24.4 mm and preferably is equal to 22.4 mm or is comprised in a range delimited by said values multiplied by a factor K1, namely:

$$(20.4\ \text{m}\times K1)<=D4<=(24.4\ \text{mm}\times K1),$$

with K1 between 0.1 and 2, i.e. 0.1<=K1<0<=2.

It should be noted that thanks to the particular above dimensioning, of the articulated quadrilateral hinge axes of the hinge according to the invention, it is possible to obtain the desired rotation positions of the refrigerator door (at least from 0° to 90° and preferably at least up to 100°) also for particularly heavy and thick doors (up to 3 inches in thickness of the doors) and at the same time conveniently allocate a helical spring adapted to exert a significant force on the quadrilateral (at least a force of 800N but that can be increased even up to 2000N), is to be underlined that with the flat springs of the hinges so far known it was not possible to achieve said results.

According to the invention, the elastically deformable means 15 comprise a helical spring 115, which is connected and acts only upon one of said two connecting elements, preferably the shorter and closer to the opening 8C of the household appliance 1. According to the invention the spring 115 is adapted to exert a force F which pushes the connecting element 13 towards the opening 8*c* of the household appliance body at least until the door 7 is rotated by 50° with respect to its first operative closing position O1.

More particularly, as can be seen in FIG. 1, the helical spring 115 is fitted on a supporting element 116 which has a first end connected to the end portion 13B of the first connecting element or connecting rod 13 at and slightly above the hinge axis A3 of said connecting rod 13, or in an eccentric position with respect to the hinge pin of the connecting rod 13 by way of a pin 116A with hinge axis A5 or a similar connecting element for example of the cam type.

Preferably, the two connecting elements 13 and 14 have mutually different lengths and the supporting element 116 for the helical spring 115 is hinged to the shorter connecting element 13, i.e. to that nearest to the opening 8*c* of the body 8 of the household appliance.

In this way, the elastically deformable means 15, and in particular the spring 115, can be housed substantially within the supporting structure 9, and preferably substantially in the space comprised between two hinge pins 16 of the connecting elements 13, 14 bound to said structure 9 which houses the spring. In this way, the spring 115 may have a length substantially equal to or slightly less than the distance D3 between the hinge axes A3 and A2 of the two connecting elements 13 and 14 connected to the supporting structure 9.

The supporting element 116 has along its outer surface a thread 116A which engages a tubular element 118, on which the spring is fitted, and having an abutment 117 for one end of the spring, for example a bolt.

The other end of the spring abuts against an inner face of the wall 9A of the first supporting structure 9.

The tubular element 118 has its other end 118A (FIG. 1) passing through a hole 119 provided in the wall 9A of the supporting element 9 and partially protruding from said hole 119. The end 118A is shaped so as to be able to insert a tool therein, such as a key so that it can rotate and change its position with respect to the supporting element 116, and consequently vary the force F exerted by the spring upon the connecting element 13.

Advantageously, the supporting element 116 is a solid element and at its free end a dowel 120 is provided adapted to lock, in a desired adjustment position of the spring 115, the tubular element 118 and consequently the spring 115, avoiding that these, for example due to vibration, change positions.

It should be noted that, thanks to the fact that the spring 115 is connected to the connecting element 13 having a lesser length, it is possible to restrict the compression movement of the spring to a 25-30% of its length at rest and then to increase the period of time wherein the spring works efficiently and constantly (i.e. to increase the useful life cycle of the spring).

It should be noted that the force F that the spring 115 exerts on the connecting element 13 increases gradually up to his maximum, for a first angular variation of said element between 0 and an angle less than 80°. After said angle the element 13 reverses the rotation and the spring gradually begins to decompress pushing the supporting structure 10 towards the open position O2 (FIG. 3, 4).

In other words, thanks to the particular dimensioning of the articulated quadrilateral the spring 15 exerts on the connecting element 13, closest to the household appliance, (and more generally on the hinge), a force which initially facilitates the closure of the hinge, i.e. is such that the door of the household appliance 7 is pushed closed against the body of the household appliance itself.

When the door 7 of the household appliance and consequently also the hinge opens, exceeding a predetermined angle (which may for example be about 60°±20°), the spring facilitates the opening of the door, because the first connecting element 13 reverses its rotation and consequently the spring pushes open and no longer in closure said first element 13 and more generally the hinge.

Preferably the spring 115 is adapted to generate a force F of about 800N when the hinge is in closing position O1 (FIG. 1), said force is sufficient to ensure that the closing element 7, i.e. the refrigerator door, is firmly in contact with the edge 8A of the refrigerator body when the hinge is closed (FIG. 1); in said situation the refrigerator may no longer need a magnetic seal between the door and said edge which ensures the contact to one another, as the force exerted by the spring on the hinge and by the latter on door 7 would be sufficient to keep it in contact with the refrigerator body.

It is to emphasize the fact that the spring 115 is connected to the connecting element 13, in correspondence to its hinge pin closer to the opening 8C of the refrigerator 1, and so as to be always positioned outside said connecting element during the movement of the latter, this allows to always have, i.e. in any operative position of the hinge, a free space S between the two connecting elements 13 and 14, wherein it is possible to insert a tube 130, for example for the passage of water or electric cables, which connects the inside of the refrigerator with the door 7 of the same. Advantageously, to increase the space for the tube 130 and to avoid pinching in particular when the hinge is in the fully open position O2 (FIG. 3), the external portion 13A of the connecting element 13 provides in correspondence to the hinge pin 16, a central window 131 adapt to allow to increase the space between the external portions 13A and 14A of the connecting elements 13 and 14 when these are in said maximum opening position O2 (as shown in FIG. 3).

Figure 4:
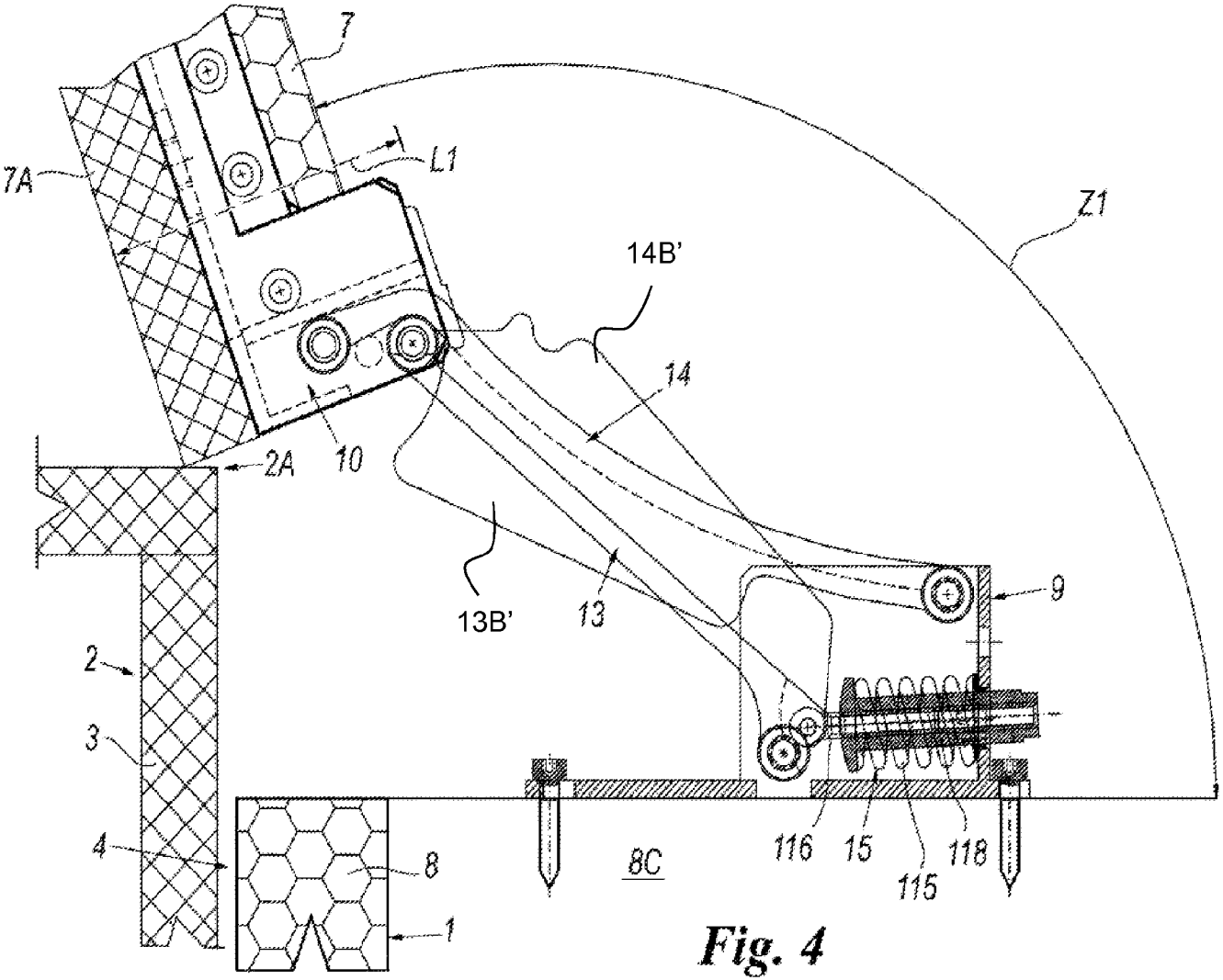
Figure 5:
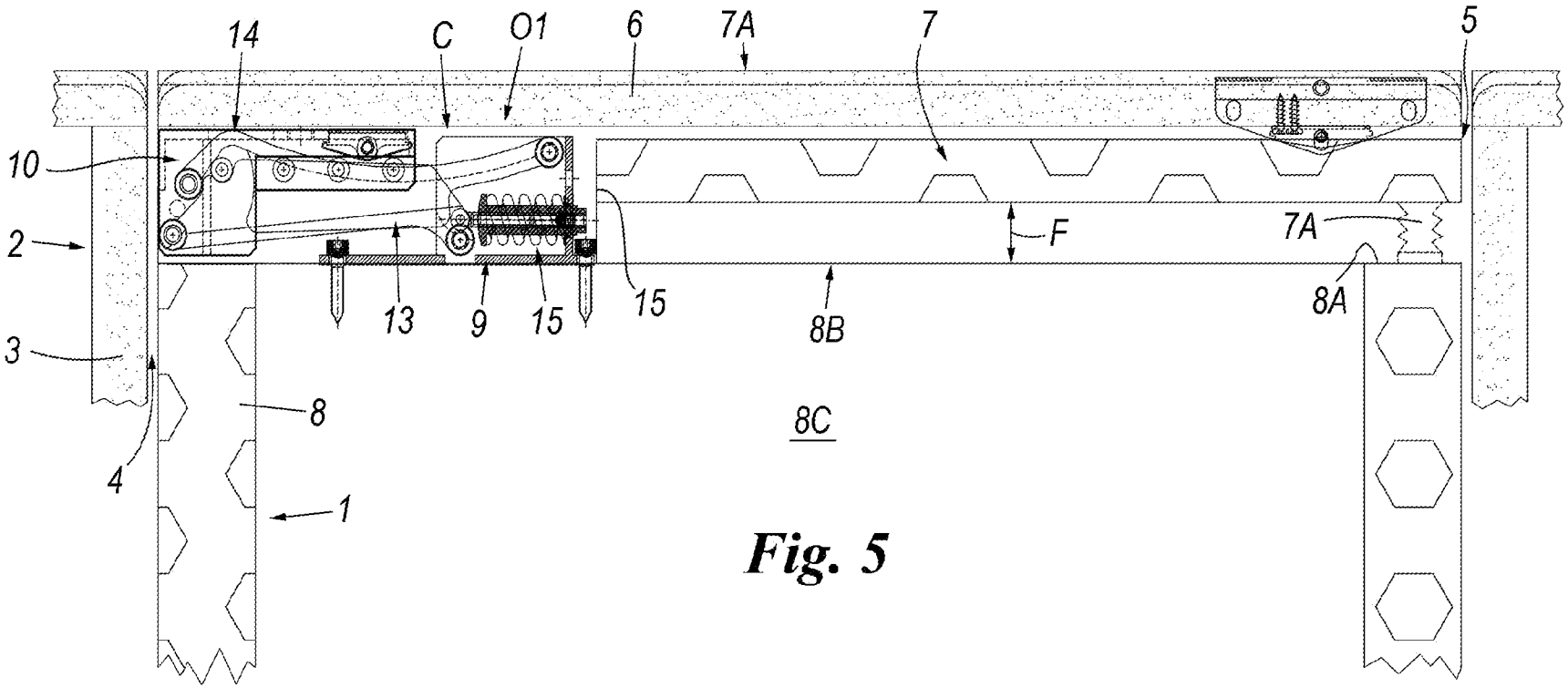

As shown in FIG. 4, if the hinge must not envisage the tube 130, it can reach a maximum opening position O3 (FIG. 4) having a rotation angle Z1 equal to 110°, and with a closing element 7B (comprising for example, the door 7 of the refrigerator, the panel 7A of the furniture element and the hinges according to the invention) having a total width L1 (FIG. 2) equal to 3 inches.

Preferably the hinge means 16 of the external portions 13A, 13B, 14A, 14B of the first and second connecting elements 14 and 13, to the first and second portions 9A and 11A of the supporting structures 9 and 11, provide pins (not shown) passing through cylindrical seats provided in the external portions of the connecting elements 13 and 14 and in holes formed in the parallel and overlapped base walls 9B (FIG. 1) of the supporting structures 9 and 11.

Advantageously both the first 14 and the second connecting element 13 comprise a first and a second connecting rod 13A, 14A of a substantially flat shape, preferably arcuate or straight profile, and lying in a vertical plane, and a wing 131B', 14B' that for the first element 14 extends from the upper edge of the connecting rod 14A, while the other connecting element 13 extends from the lower edge of the connecting rod 13A. Said wings 14B', 13B' are sized and shaped so that during the rotation movement of the elements 14 and 13 of the quadrilateral of the hinge they would always close the open space that is created between a connecting rod 13A and the other 14A so as to prevent a user of the household appliance from inserting a finger between said parts of the hinge i.e. that the hinge is designed to overcome the so-called test finger test. Thanks to the wings 14B', 13B', hinge plastic covers of the connecting rods can be avoided, that is covers that are unsightly and of dubious effectiveness with respect to the test finger test, and at the same time it is possible to obtain connecting elements with greater bending strength with respect to elements which provide only a connecting rod without wings. It should be noted that the wings 14B' and 13B' both provide a chamfer 13C 14C (FIG. 1) shaped so as to allow, when the hinge is in the closed position, to reach one of the holes 21 (indicated by the number 21F in FIG. 1) so that it can still tighten at least one of the screws passing in the holes 21 and adapted to bound the hinge to a support of the refrigerator door.

Advantageously the hinge in the closed position has a substantially parallelepiped shape and the connecting elements 14, 13 are substantially housed inside the supporting structures 9, 11, i.e. between the vertical walls 11A 11C and 9A 9C of said structures and between walls or horizontal wings departing from the upper and lower edges of said vertical walls.

The hinge also provides advantageously, means 160 (FIG. 1) for adjusting the position of the panel 7A with respect to the closing element 7 of the household appliance, said means are associated with the second supporting structure 11, said adjusting means are of the type described in the U.S. Pat. No. 5,471,709, of the same applicant of the present application, the content of which is to be intended comprised in the present text.

Finally, it is reaffirmed that the embodiment described above has been provided only by way of example and that numerous modifications are possible, all falling within the same inventive concept, so for example the hinge according to the invention can also be used in household appliances, and in particular not built-in refrigerators, i.e. of the free-standing type, and with doors having thicknesses up to three inches.

In addition, the panel 7A of the door covering 7 of a refrigerator may be made in any suitable material such as wood or sheet metal, for example stainless steel, which entirely covers the refrigerator door and possibly also its lateral sides.

The invention claimed is:

1. A hinge for a household appliance, adapted to connect at least one flat closing element to a body of the household appliance in correspondence to an opening provided in the body, the hinge allowing the flat closing element to rotate between a first operative position wherein the flat closing element closes the opening, and a second operative position angularly spaced by at least 90° with respect to the first operative position, the hinge comprising:

a first supporting structure adapted to be bound to the body of the household appliance, a second supporting structure adapted to be bound to the flat closing element, a first connecting element and a second connecting element, wherein the first connecting element and the second connecting element are adapted to connect the first supporting structure to the second supporting structure, and an elastically deformable body which interacts with at least one of the first connecting element and the second connecting element to exert a force that pushes the closing element against the opening of the body at least when the closing element is in the first operative position, wherein the first connecting element, the second connecting element, at least a first portion of the first supporting structure, and at least a second portion of the second supporting structure form an articulated quadrilateral, wherein the articulated quadrilateral is adapted to define a member for opening and closing the closing element between the first operative position and the second operative position, wherein the first connecting element comprises a first end and a second end, the first end comprising a first hinge axis about which the first connecting element can rotate, the second end comprising a second hinge axis about which the first connecting element can rotate, wherein the second connecting element comprises a third end and a fourth end, the third end comprising a third hinge axis about which the second connecting element can rotate, the fourth end comprising a fourth hinge axis about which the second connecting element can rotate, wherein, in the first operative position, a first distance between the first hinge axis and the second hinge axis is greater than or equal to 165.5 mm times a value K1, and less than or equal to 169.5 mm times said value K1, wherein, in the first operative position, a second distance between the third hinge axis and the fourth hinge axis is greater than or equal to 131 mm times said value K1, and less than or equal to 135 mm times said value K1, wherein, in the first operative position, a third distance between the second hinge axis and the fourth hinge axis is greater than or equal to 53.2 mm times said value K1, and less than or equal to 57.2 mm times said value K1, wherein, in the first operative position, a fourth distance between the first hinge axis and the third hinge axis is greater than or equal to 20.4 mm times said value K1, and less than or equal to 24.4 mm times said value K1, wherein said value K1 is between 0.1 and 2.0.

2. The hinge according to claim 1, wherein the elastically deformable body comprises a helical spring.

3. The hinge according to claim 2, wherein:

the elastically deformable body comprises a supporting element on which is fitted the helical spring, the supporting element being coaxial to the helical spring, the supporting element connecting one of the first connecting element and the second connecting element to the first supporting structure.

4. The hinge according to claim 3, wherein the supporting element provides a first hinge pin said first hinge pin being eccentric with respect to a second hinge pin of the connecting element which is connected to said supporting element.

5. The hinge according to claim 2, wherein the helical spring is housed substantially within the first supporting structure.

6. The hinge according to claim 2, wherein the helical spring is housed in the first supporting structure and is provided substantially in a space comprised between a first hinge pin of the first connecting element and a second hinge in of the second connecting element to said first structure which houses the spring.

7. The hinge according to claim 2, wherein the helical spring has a length less than or equal to the third distance.

8. The hinge according to claim 3, wherein the first distance is less than the second distance, and wherein the supporting element for the helical spring is hinged to the second connecting element.

9. The hinge according to claim 1, further comprising a tube for passing a liquid between the body of the household appliance and the at least one flat closing element, wherein at least a portion of the tube is provided in a space delimited by the first connecting element and the second connecting element.

10. The hinge according to claim 3, wherein the supporting element has a thread along its outer surface which engages a tubular element on which the spring is fitted, wherein the tubular element has an abutment for a first end of the spring, wherein a second end of the spring abutts an inner face of a wall of the first supporting structure, the tubular element having an end passing through a hole provided in the wall of the first supporting structure and partially projecting from the hole.

11. The hinge according to claim 1, wherein
the first connecting element comprises
a first connecting rod, having a substantially flat shape and lying in a vertical plane and
a first wing,
wherein the second connecting element comprises
a second connecting rod having a substantially flat shape and lying in a vertical plane, and
a second wing,
wherein during the rotation movement of the connecting rods close the open space created between a connecting rod and the other to prevent a user of the household appliance from inserting a finger between said connecting rods.

12. The hinge according to claim 1, which in the closed position has a substantially parallelepiped shape.

13. A hinge for a household appliance, adapted to connect at least one flat closing element to a body of the household appliance in correspondence to an opening provided in the body,
the hinge allowing the flat closing element to rotate between
a first operative position wherein the flat closing element closes the opening, and
a second operative position angularly spaced by at least 90° with respect to the first operative position,
the hinge comprising:
a first supporting structure adapted to be secured to a structure or front bearing wall of the body of the household appliance,
a second supporting structure adapted to be bound to the flat closing element,
a first connecting element and a second connecting element, wherein the first connecting element and the second connecting element are adapted to connect the first supporting structure to the second supporting structure,
wherein the first connecting element is closer to the structure or front bearing wall of the body of the household appliance compared to the second connecting element, and
an elastically deformable member which interacts with at least one of the first connecting element and the second connecting element to exert a force that pushes the closing element against the opening of the body of the household appliance at least when the closing element is in the first operative position,
wherein the first connecting element, the second connecting element, at least a first portion of the first supporting structure, and at least a second portion of the second supporting structure form an articulated quadrilateral having at least one side lying in a plane perpendicular to the flat closing element,
wherein the articulated quadrilateral is adapted to define a member for opening and closing the closing element between the first operative position and the second operative position,
wherein the first connecting element comprises
a first end and
a second end,
the first end comprising a first hinge axis about which the first connecting element can rotate,
the second end comprising a second hinge axis about which the first connecting element can rotate,
wherein the second connecting element comprises
a third end and
a fourth end,
the third end comprising a third hinge axis about which the second connecting element can rotate,
the fourth end comprising a fourth hinge axis about which the second connecting element can rotate,
wherein the elastically deformable member comprises a helical spring, and a supporting element on which the helical spring is fitted, the supporting element being coaxial to the helical spring;
the supporting element connecting one of the first connecting element and the second connecting element to the first supporting structure;
wherein the supporting element provides a first hinge pin said first hinge pin being eccentric with respect to a second hinge pin of the connecting element which is connected to said supporting element;
wherein the helical spring is housed in the first supporting structure and is provided substantially in a space comprised between a first hinge pin of the first connecting element and a second hinge pin of the second connecting element to said first structure which houses the spring,
wherein, in the first operative position, a first distance between the first hinge axis and the second hinge axis is greater than or equal to 165.5 mm times a value K1, and less than or equal to 169.5 mm times said value K1,
wherein, in the first operative position, a second distance between the third hinge axis and the fourth hinge axis is greater than or equal to 131 mm times said value K1, and less than or equal to 135 mm times said value K1,
wherein, in the first operative position, a third distance between the second hinge axis and the fourth hinge axis is greater than or equal to 53.2 mm times said value K1, and less than or equal to 57.2 mm times said value K1,
wherein, in the first operative position, a fourth distance between the first hinge axis and the third hinge axis is greater than or equal to 20.4 mm times said value K1, and less than or equal to 24.4 mm times said value K1,
wherein said value K1 is between 0.1 and 2.0.

14. The hinge according to claim 13, wherein the helical spring has a length less than or equal to the third distance.

15. The hinge according to claim 13, wherein the helical spring always remains substantially housed within the first supporting structure.

16. The hinge according to claim 13, further comprising a tube for passing a liquid between the body of the household appliance and the at least one flat closing element,
wherein at least a portion of the tube is provided in a space delimited by the first connecting element and the second connecting element.

17. The hinge according to claim 13, wherein the supporting element has a thread along its outer surface which engages a tubular element on which the spring is fitted,
wherein the tubular element has an abutment for a first end of the spring,
wherein a second end of the spring abutts an inner face of a wall of the first supporting structure,
the tubular element having an end passing through a hole provided in the wall of the first supporting structure and partially projecting from the hole.

18. The hinge according to claim 1, wherein the second operative position is angularly spaced by at least 100° with respect to said first operative position.

19. The hinge of claim 1, wherein the flat closing element of the household appliance is a door of the appliance.

20. The hinge according to claim 1, wherein the first supporting structure is adapted to be bound to a front bearing wall of the body of said household appliance.

21. The hinge according to claim 13, wherein, in the first operative position, a first distance between the first hinge axis and the second hinge axis is greater or equal to (165.5 mm×K1), and less or equal to (169.5 mm×K1), wherein, in the first operative position, a second distance between the third hinge axis and the fourth hinge axis is greater or equal to (131 mm×K1) and less or equal to (135 mm×K1), wherein, in the first operative position, a third distance between the second hinge axis and the fourth hinge axis is greater or equal to (53.2 mm×K1) and less or equal to (57.2 mm×K1), wherein, in the first operative position, a fourth distance between the first hinge axis and the third hinge axis is greater or equal to (20.4 m×K1) and less or equal to (24.4 mm×K1), wherein K1 is from 0.1 to 2.

22. The hinge according to claim 13, wherein the first distance is 167.5 mm, wherein the second distance is 133 mm, wherein the third distance is 55.2 mm, wherein the fourth distance is 22.4 mm.

23. A hinge for a household appliance, adapted to connect at least one flat closing element to a body of the household appliance in correspondence to an opening provided in the body, the hinge allowing the flat closing element to rotate between a first operative position wherein the flat closing element closes the opening, and a second operative position angularly spaced by at least 90° with respect to the first operative position, the hinge comprising:

a first supporting structure adapted to be bound to the body of the household appliance, a second supporting structure adapted to be bound to the flat closing element, a first connecting element and a second connecting element, wherein the first connecting element and the second connecting element are adapted to connect the first supporting structure to the second supporting structure, and an elastically deformable body which interacts with at least one of the first connecting element and the second connecting element to exert a force that pushes the closing element against the opening of the body at least when the closing element is in the first operative position, wherein the first connecting element, the second connecting element, at least a first portion of the first supporting structure, and at least a second portion of the second supporting structure form an articulated quadrilateral, wherein the articulated quadrilateral is adapted to define a member for opening and closing the closing element between the first operative position and the second operative position, wherein the first connecting element comprises a first end and a second end, the first end comprising a first hinge axis about which the first connecting element can rotate, the second end comprising a second hinge axis about which the first connecting element can rotate, wherein the second connecting element comprises a third end and a fourth end, the third end comprising a third hinge axis about which the second connecting element can rotate, the fourth end comprising a fourth hinge axis about which the second connecting element can rotate, wherein, in the first operative position, a first distance between the first hinge axis and the second hinge axis is greater than or equal to 165.5 mm times a value K1, and less than or equal to 169.5 mm times said value K1, wherein, in the first operative position, a second distance between the third hinge axis and the fourth hinge axis is greater than or equal to 131 mm times said value K1, and less than or equal to 135 mm times said value K1, wherein, in the first operative position, a third distance between the second hinge axis and the fourth hinge axis is greater than or equal to 53.2 mm times said value K1, and less than or equal to 57.2 mm times said value K1, wherein, in the first operative position, a fourth distance between the first hinge axis and the third hinge axis is greater than or equal to 20.4 mm times said value K1, and less than or equal to 24.4 mm times said value K1, wherein said value K1 is between 0.1 and 2.0, wherein the elastically deformable body comprises a helical spring, wherein the elastically deformable body comprises a supporting element on which is fitted the helical spring, the supporting element being coaxial to the helical spring, the supporting element connecting one of the first connecting element and the second connecting element to the first supporting structure, wherein the supporting element provides a first hinge pin said first hinge pin being eccentric with respect to a second hinge pin of the connecting element which is connected to said supporting element, wherein the first distance is less than the second distance, and wherein the supporting element for the helical spring is hinged to the second connecting element.

* * * * *